United States Patent [19]

Petty, Sr.

[11] 4,451,072

[45] May 29, 1984

[54] GATE LATCH

[76] Inventor: William E. Petty, Sr., P.O. Box 6464, Tyler, Tex. 75711

[21] Appl. No.: 360,578

[22] Filed: Mar. 22, 1982

[51] Int. Cl.[3] ..... E05C 3/04

[52] U.S. Cl. ..... 292/128; 292/31; 292/104; 292/108

[58] Field of Search ..... 292/128, 104, 108, 31, 292/125, 205, 210, 24

[56] References Cited

U.S. PATENT DOCUMENTS 259,559 6/1882 Langley ..... 292/108 X 2,653,044 9/1953 Vickers ..... 292/108

2,809,063 10/1957 Taylor ..... 292/218

3,514,142 5/1970 Smith ..... 292/108 X

*Primary Examiner*—Richard E. Moore

*Attorney, Agent, or Firm*—G. Turner Moller

[57] ABSTRACT

A gate latch is provided for a stockade type fence. The latch may be opened from either side of the gate. Provisions are made whereby a padlock may be applied to the latch on either side of the gate. Means are provided for positively captivating the latch post carried by the gate to prevent the gate from being opened by merely forcing the latch post out of its associated slot in the latch.

9 Claims, 5 Drawing Figures

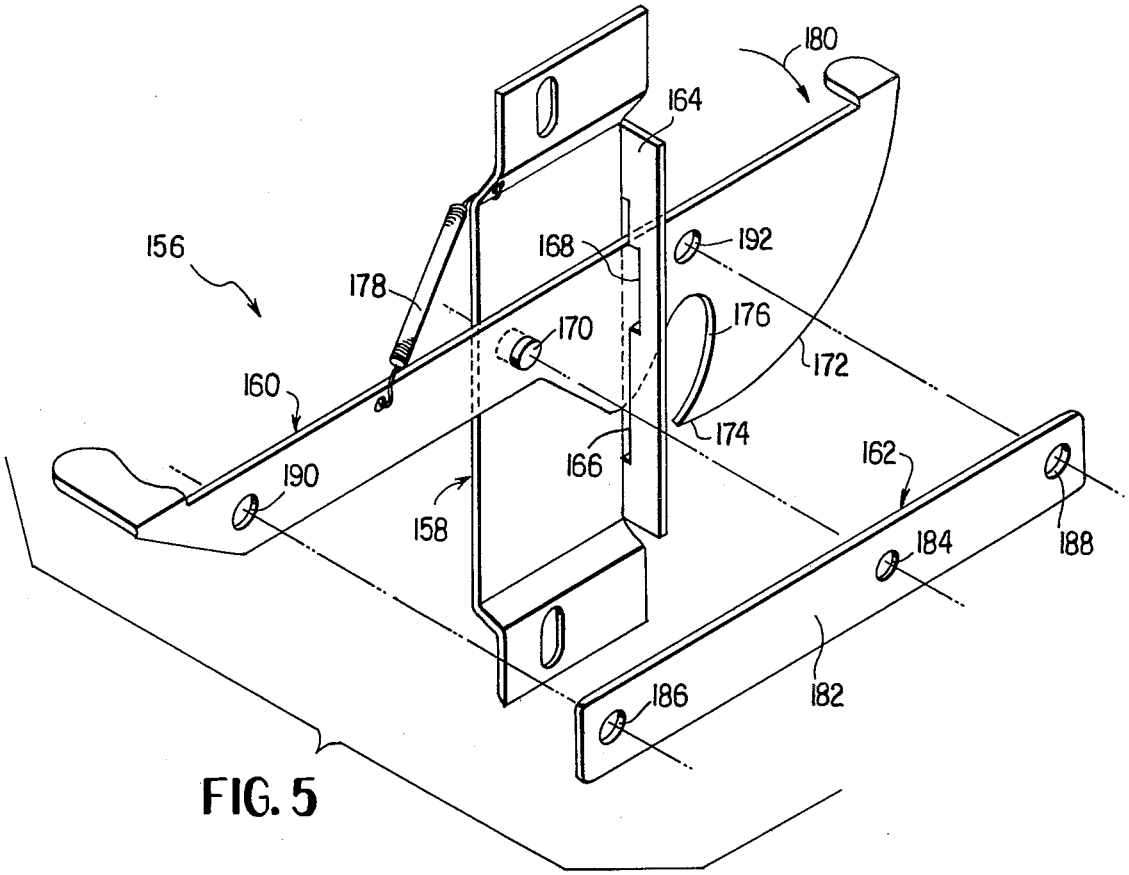
FIG. 5
FIG. 4
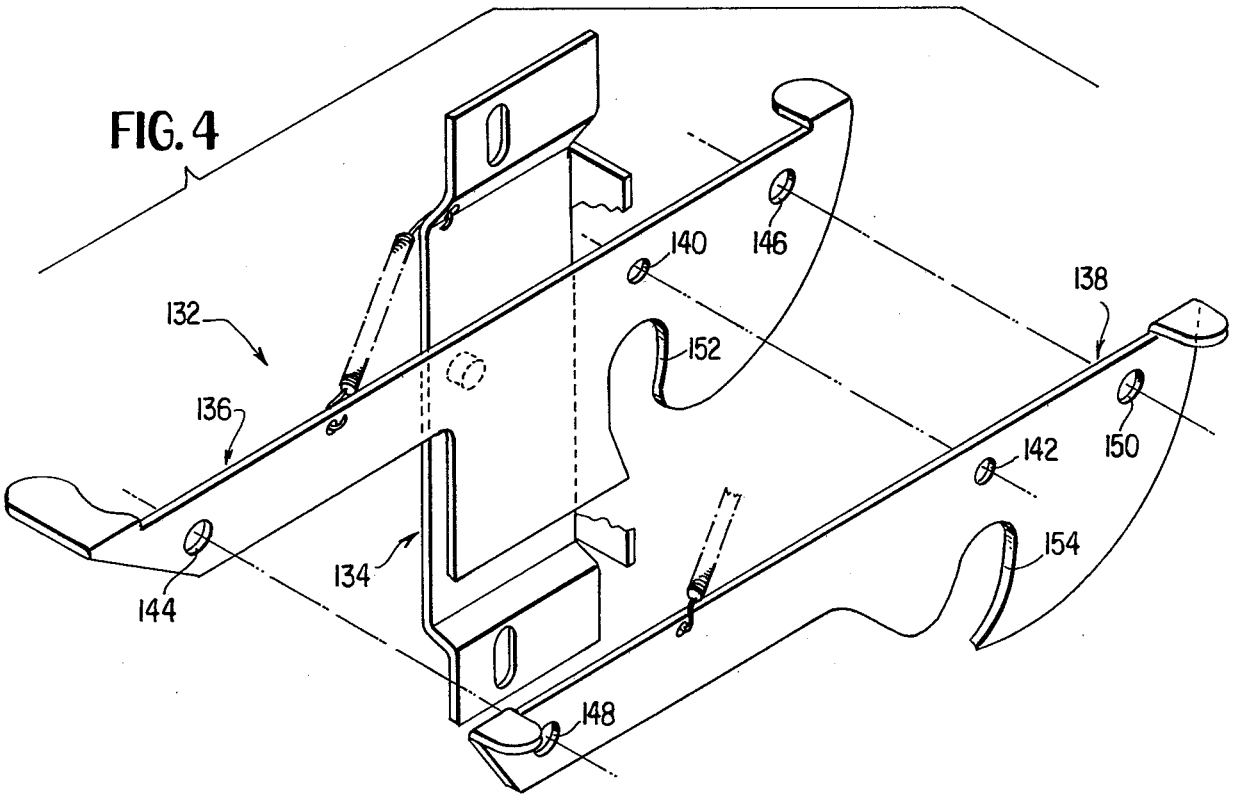

GATE LATCH

This invention relates to gate latches for a stockade type fence and more particularly to a gate latch of the type which may be manipulated from either side of the gate.

Stockade type fences are very common in urban and suburban America and typically comprise a series of wooden posts spaced about the periphery of the area to be enclosed. The posts are sunk in the ground and are interconnected by a pair of vertically spaced horizontally extending wooden runners to which are nailed a series of upright wooden planks which constitute the barrier to entry. This type stockade fence is extremely common to control access to the backyards of single family dwellings, apartment areas, swimming pools and the like.

One of the common problems of stockade type fences is that the gate latches normally used therewith are quite insecure. The conventional arrangement is that the gate carries a horizontally extending latch post which contacts, in the gate closing direction, an arcuate cam face of a latching lever. The engagement of the latch post with the camming face causes the latch lever to pivot upwardly to allow the latch post to enter a reentrant slot in the latch lever. The latch lever is spring biased toward a latched position and the reentrant slot is configured to prevent simple horizontal swinging movement of the gate away from the latch when the latch is in the latched position.

The difficulty with the prior art latches is that the reentrant slot is downwardly facing and is unobstructed so that play in the gate hinges allows the latch post to be depressed downwardly out of the reentrant slot of the gate latch so that the gate may be opened without manipulating the latch. Accordingly, even if the latch were locked in their intended fashion, as with a padlock, the latch could be circumvented as discussed more fully hereinafter. There are some gates or gate hinges which initially have enough play so that the latch post can initially be moved out of the latch reentrant slot merely by putting one's weight on the gate. Even if a gate has very little play when initially installed, sagging of the gate or gate hinges almost universally occurs as the fence ages. Consequently, there are few or no stockade fence gates which cannot be forced merely by putting one's weight on the gate until the latch post moves out of the reentrant slot and then swinging the gate open.

One would think that the simplest technique for obviating this difficulty would be to mount the conventional gate latch upside down so that the reentrant slot is upwardly facing rather than downwardly directed. It turns out that this is no solution for a number of reasons. First, if the gate latch were to carry part of the weight of the gate, it would inherently loosen in time and add to play in the gate hinges. Second, and more important, if the gate hinges have sufficient play that the latch can be circumvented merely by pushing downwardly on the gate, then it follows that the latch can be circumvented by pulling upwardly on the gate.

The technique employed in this invention is to configure the gate latch in such a way that the reentrant slot of the latching lever is at least partially closed or obstructed so that the latch post cannot move out of the slot until the latch is manipulated in its intended fashion. In accordance with a preferred embodiment of this invention, a second or locking lever is mounted on the first or latching lever to at least partially close or obstruct the reentrant slot in the gate latched position. In another embodiment of the invention, the prior art latching lever is reconfigured so that the reentrant slot cooperates with the latch bracket in the gate latched position to at least partially close or obstruct the reentrant slot.

Disclosures of general interest are found in U.S. Pat. Nos. 336,714; 2,312,184 and 2,671,683.

It is an object of this invention to provide an improved gate latch.

A more specific object of this invention is to provide an improved gate latch for a stockade fence which positively captivates the latch post in the gate latched position.

Other objects and advantages of this invention will become more fully apparent as this description proceeds, reference being made to the accompanying drawings and appended claims.

IN THE DRAWINGS:

FIG. 4 is an exploded isometric view of another embodiment of this invention; and FIG. 5 is an exploded isometric view of a further embodiment of this invention.

Figure 1:
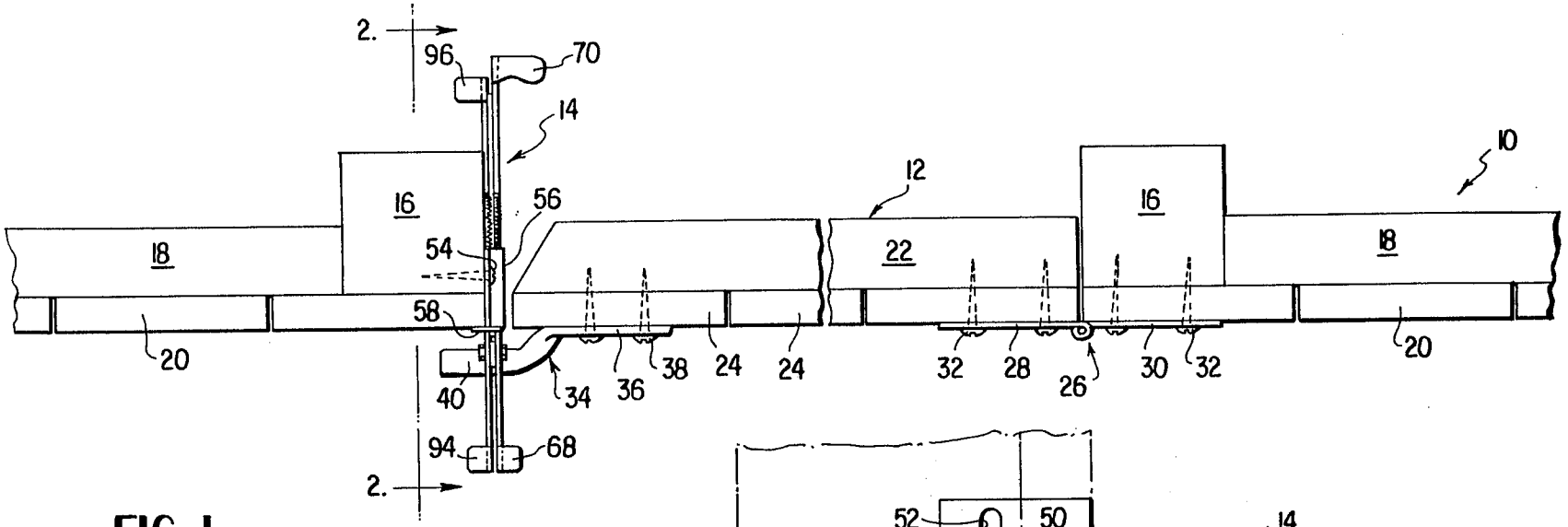
FIG. 1 is a top plan view of a fence, gate and gate latch in accordance with the principles of this invention.
Figure 2:
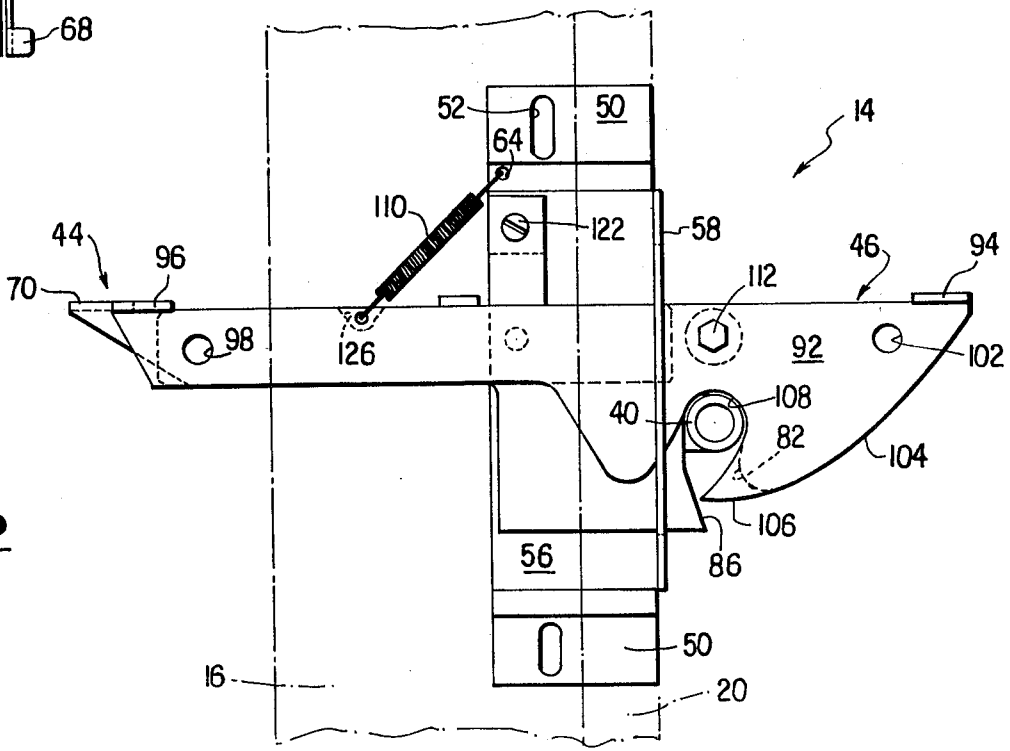
FIG. 2 is an enlarged side elevational view of the gate latch of FIG. 1 as may be viewed from along line 2—2 in the direction indicated by the arrows.
Figure 3:
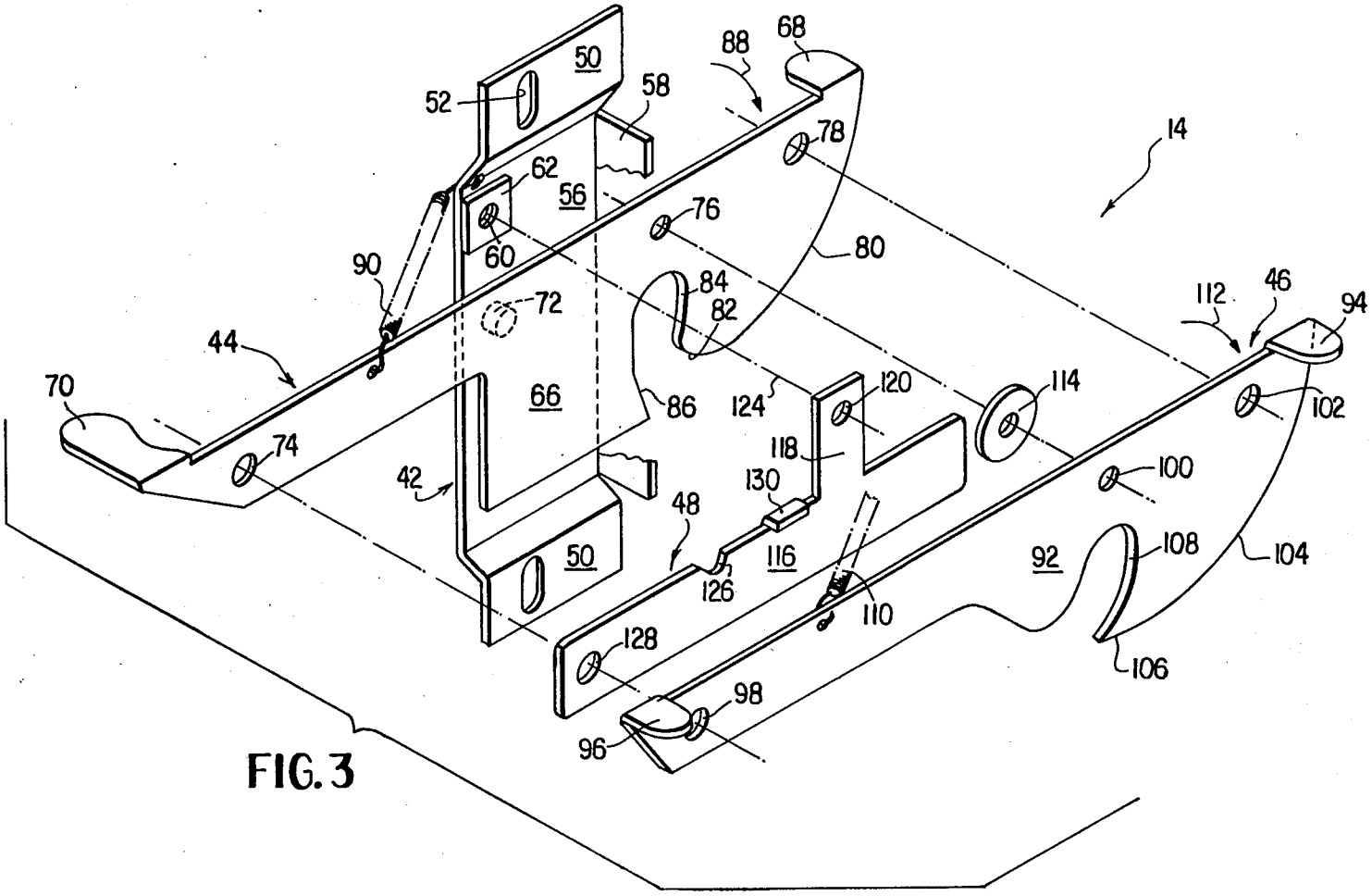
FIG. 3 is an exploded isometric view of the gate latch of FIGS. 1 and 2.

Referring to FIGS. 1–3, there is illustrated a fence 10 having a gate 12 therein which is secured in a closed position by a latch 14 of this invention. The fence 10 is of conventional construction and comprises a plurality of vertical posts 16 embedded in the ground at regular intervals. Except across the gate opening, the posts 16 are interconnected by horizontally extending, vertically spaced wooden runners 18 to which are nailed a plurality of vertically extending wooden planks 20. The fence 10 will accordingly be recognized by those skilled in the art as being of the stockade type.

The gate 12 is positioned between posts 16 and comprises two or more horizontal runners 22 interconnected by vertically extending planks 24. The gate 12 is connected to an adjacent post 16 by two or more hinges 26 comprising hinge halves 28, 30 secured to the gate 12 and post 16 by fasteners 32 such as screws or nails. It will be seen that the hinge 26 mounts the gate 12 for pivotal movement about a vertical axis between the gate closed position illustrated in FIG. 1 and an open position. Affixed to the gate 12 adjacent the free swinging end thereof is a latch post 34 comprising a first segment 36 having apertures therein receiving fasteners 38 for securing the latch post 34 to the gate 12. The latch post 34 also comprises a second segment 40 extending beyond the end of the gate 12. The second segment 40 typically is spaced from the plane of the planks 24. It will accordingly be seen that the fence 10 and gate 12 are of conventional construction.

The latch 14 is designed to hold the latch post 34 in the gate closed position, to release the latch post 34 upon actuation of the latch from either side of the gate 12 and to retain or lock the latch post 34 in its closed position. To these ends, the latch 14 comprises, as major components, a bracket 42, a latching lever 44, a captivating lever 46 and a locking mechanism 48. As will be noted more fully hereinafter, a number of the components of the latch 14 are substantially identical to the components of latches that are presently commercially available.

The bracket 42 is one of these components. Typically, the bracket 42 is manufactured from a single metallic piece and comprises a pair of coplanar ears 50 providing apertures 52 therein for receiving fasteners 54 for securing the bracket 42 to the post 16 as shown in FIGS. 1 and 3. Offset away from the plane of the ears 50 is a metal section 56. Extending at right angles from the section 56 is a slotted leg 58 which abuts the plank 20 as shown in FIG. 1. The leg 58 in FIG. 3 is broken in order to expose the latching lever 44. The shape of the slot therein may be of any suitable size or shape so long as it accommodates the levers 44, 46. As will be more fully apparent hereinafter, the latching lever 44 and the captivating lever 46 extend through the slot in the leg 58 and are accordingly constrained thereby to movement in a generally vertical plane.

The bracket 42 also includes a threaded opening 60 as may be provided by a nut 62 welded or otherwise secured to the bracket section 56. An opening 64 is provided in the bracket section 56 for purposes more fully explained hereinafter.

The latching lever 44 is also substantially identical to the prior art components. The lever 44 is typically formed from a single planar metallic piece and comprises a planar vertically extending body 66 having ears 68, 70 on opposite sides of the bracket 42 for manipulating the lever 44 from opposite sides of the gate 12 as may be seen from FIG. 1. The lever 44 is pivotally mounted on the bracket 42 by a pin 72 which is shown as comprising a pin on the backside of the body 66 extending into an opening provided in the bracket section 56. It will be seen that the lever 44 is mounted for vertical swinging movement as constrained by the slot in the leg 58. For purposes more fully explained hereinafter, the lever body 66 provides a plurality of openings 74, 76, 78.

The forward end of the latching lever 44, i.e. the end engaging the latch post 34, comprises an arcuate cam surface 80 merging through a rounded corner 82 into a vertically extending reentrant slot 84 disposed adjacent the surface of the slotted leg 58. The opposite side of the reentrant slot 84 merges with a striker face 86 for purposes more fully explained hereinafter. As will be evident to those skilled in the art, the latching lever 44 is more-or-less identical to its counterpart in the commercial latch. In the commercially available latch, the bracket 42 is affixed to the gate post 16 so that the latch segment 40 of the gate 12 engages the cam surface 80 as the gate 12 is swung toward its closed position. The latching lever 44 is pivoted about the axis of the pin 72 so that the latch segment 40 passes along the cam surface 80 and rounded corner 82 to strike the face 86 and ultimately pass into the vertical reentrant slot 84. As the latch segment 40 enters the slot 84, the latching lever 44 is biased in a latching direction illustrated by the arrow 88 due to the action of a return spring 90 received in the opening 64 and connected to the latching lever 44.

The commercially available latches typically include means to selectively prevent rotation of the latching lever 44 relative to the bracket 42. Typically, these devices require a padlock to couple the latching lever 44 to a locking mechanism. The purpose of these locking devices is to prevent easy access through the gate 12. With the commercially available latch, this approach is worse than useless since it may foster an unwarranted sense of security on the part of the property owner. As mentioned previously, locking mechanisms of the prior art latches may readily be circumvented merely by pushing downwardly on the gate 12 until the latch post 34 passes out of the reentrant slot 84. With the latch post so depressed, the gate 12 may be swung outwardly to the gate open position.

Broadly, the approach of this invention is to provide a lockable gate latch by obstructing the reentrant slot 84 after the latch post 34 is received therein so that the latch post 34 cannot be moved out of the reentrant slots 84 unless the latch is manipulated. Manipulation of the latch may selectively be prevented by the locking mechanism 48 to be described hereinafter.

To these ends, the captivating lever 46 is provided. The captivating lever 46 is typically formed from a single piece of planar metallic material providing a planar body 92 having a pair of ears 94, 96 at opposite ends thereof so that the captivating lever 46 may be manipulated from opposite sides of the gate 12 as shown best in FIG. 1. The body 92 provides openings 98, 100, 102 which align with the openings 74, 76, 78 respectively in the latching lever 44 as may be seen in FIGS. 2 and 3. The forward end of the captivating lever 46 includes a surface 104 which conveniently is identical in shape to the cam surface 80. The surface 104 terminates in a pointed projection 106 which extends across the gap between the rounded corner 82 and the striker face 86 to effectively block or obstruct movement of the latch segment 40 out of the reentrant slot 84 as may best be seen in FIG. 2. Starting at the projection 106, the captivating lever 46 provides a reentrant slot 108 which, at the upper end thereof, overlaps the slot 84 to provide a recess for the latch segment 40. A spring 110 extends between the captivating lever 46 and the opening 64 in the bracket 42 to bias the captivating lever 46 in a captivating direction indicated by the arrow 112.

The captivating lever 46 is preferably mounted on the latching lever 44 for independent pivotable movement relative thereto. To these ends, a fastener 112, such as a nut and bolt, extend through the aligned openings 76, 100 to support the captivating lever 46 on the latching lever 44 while allowing independent pivotal movement relative thereto. A spacer 114, in the form of a washer, is positioned between the levers 44, 46 and is captivated by the fastener 112 to prevent binding of the locking mechanism 48 as will be more fully pointed out hereinafter.

When closing the gate 12, the latch post 34 engages the cam surfaces 80, 104 and thereby pivots the levers 44, 46 in a counterclockwise direction as viewed in FIGS. 2 and 3 until the latch post 34 is positioned adjacent the gap between the rounded corner 82 and the striker face 86. At some time during closing of the gate 12, the user must manipulate the captivating lever 46 to further bias it in a counterclockwise direction, as by depressing the ear 96 or elevating the ear 94, to move the projection 106 out from between the rounded corner 82 and the striker face 86. This allows movement of the latch segment 40 into the reentrant slot 84. As the gate 12 reaches the closed position, the captivating lever 46 may be released so that the spring 110 biases the lever 46 to the position shown in FIG. 2 to captivate the latch segment 40 in the reentrant slot 84 of the lever 44.

In order to open the gate 12 and release the latch segment 40, the user depresses the ears 70, 96 on one side of the gate 12 or elevates the ears 68, 94 on the other side. The lever 46 is rotated to a greater extent than the lever 44 in order to move the projection 106 out of the gap between the rounded corner 82 and the striker face 86. This effectively unblocks movement of the latch segment out of the reentrant slot 84. When the latch segment 40 clears the rounded corner 82, the gate 12 may be moved to its open position.

In order to lock the gate 12 in its closed position, the locking mechanism 48 is provided. The locking mechanism 48 comprises a lever manufactured from a single piece of planar metallic material and includes a body 116 having an upstanding leg 118 providing an opening 120 therein receiving a threaded fastener 122 coupled to to the nut 62 for supporting the locking mechanism 48 on the bracket 42 and allowing pivotal movement thereof about the axis 124. The body 116 includes a notch 126 which allows the springs 90, 110 to be connected to their respective levers 44, 46 without interference as may be seen best in FIG. 2. The locking mechanism 48 also includes an opening 128 aligned with the openings 74, 98 of the levers 44, 46 respectively. A tab 130 on the locking body 116 overlies the captivating lever 46 so that rotation of the captivating lever 46 in the captivating direction 112 causes rotation of the locking mechanism 48 in the same direction.

When it is desired to lock the levers 44, 46 in their closed position, the hasp of a padlock may be placed through the aligned openings 74, 128, 98. In this fashion, relative pivotal movement between the levers 44, 46 is prevented. It will be seen, of course, that unless the lever 46 can pivot relative to the lever 44, the projection 106 cannot be moved to unblock the path of movement of the latch segment 40 out of the reentrant slot 84.

Referring to FIG. 4, a latch 132 is illustrated comprising another embodiment of this invention. The latch 132 is identical, in all respects, to the latch 14 except that the locking mechanism 48, the nut 62 and the spacer 114 have been eliminated. Accordingly, the brackets 42, 134 are identical, the latching levers 44, 136 are identical and the captivating levers 46, 138 are identical. The levers 136, 138 are connected by a threaded fastener (not shown) extending through aligned openings 140, 142 in much the same manner that the fastener 112 mounts the lever 46 on the lever 44 while allowing relative pivotal movement therebetween. Since the locking mechanism 48 has been eliminated, it would seem that the locking feature afforded thereby has been eliminated. It is desirable, of course, to provide a locking feature. To this end, the lever 136 provides openings 144, 146 on opposite sides of the gate 12 which align respectively with openings 148, 150 in the captivating lever 138. By placing a padlock through the openings 144, 148 or through the openings 146, 150, relative rotation between the levers 136, 138 is no longer possible. Accordingly, the latch post 34 necessarily remains captivated between the reentrant slots 152, 154 of the levers 136, 138.

Referring to FIG. 5, a latch 156 comprising another embodiment of this invention is illustrated. The latch 156 comprises, as major components, a bracket 158, a latching and captivating lever 160 and a locking mechanism 162. The bracket 158 is identical to the bracket 42 except for the shape of the slot in the leg 164. The leg 164 provides a compound shaped slot 166 having a rectilinear enlargement 168 rather than the simple rectangular slot envisioned in the leg 58. In addition, the connection between the bracket 158 and the lever 160 is shown as reversed comprising a pin 170 on the bracket 158 extending through an opening in the lever 160.

The lever 160 is quite similar to the captivating lever 46 in that the forward end comprises a cam surface 172 terminating in a pointed projection 174 which is spaced, in the latch closed position, from the slotted leg 164 a distance less than the diameter of the latch segment 40. A reentrant slot 176 receives the latch segment 40 in the closed position of the gate 12.

As the gate 12 is moved toward its closed position, the latch segment 40 contacts the cam surface 172 and biases the lever 160 in a counterclockwise direction. The latch segment 40 will not readily pass the projection 174 and some manipulation of the lever 160 by the user may be required to pass the latch segment 40 into the reentrant slot 176. As the latch segment 40 moves into the slot 176, a spring 178 biases the lever 160 in a latching direction indicated by the arrow 180. As the lever 160 approaches its fully closed position, the projection 174 approaches the leg 164 a distance less than the diameter of the latch segment 40. Thus, if the lever 160 can be selectively precluded from pivotal movement relative to the bracket 158, the latch segment 40 may be locked in place and not released until manipulation of the latch 156 is allowed.

To these ends, the locking mechanism 162 is provided. The locking mechanism 162 comprises a simple planar metallic body 182 having an opening 184 received on the pin 170. The body 182 extends through the enlargment 168 of the slot 166 and is thereby prevented from rotation relative to the bracket 158. The body 182 also provides a pair of openings 186, 188 which align with the openings 190, 192 in the lever 160. In order to prevent rotation of the lever 160 and thereby to prevent movement of the latch segment 40 out of the reentrant slot 176, a padlock may be placed through the aligned openings 186, 190 on one side of the gate 12 or through the openings 188, 192 on the other side.

It will accordingly be seen that there is provided an improved latch in accordance with the principles of this invention.

I claim:

1. A latch for a fence gate of the type pivoted between a pair of spaced posts for movement about a vertical axis and having a latch post carried thereon, comprising a bracket for attachment to one of the fence posts;

a first lever pivoted to the bracket and having a reentrant slot for receiving the latch post in a latched position of the latch;

means carried by the bracket for closing the reentrant slot of the lever in the latched position of the latch for locking the latch post in the reentrant slot, the closing means comprising a second lever pivoted for movement relative to the first lever and including means for closing the reentrant slot of the first lever in the latched position of the latch for locking the latch post in the reentrant slot;

means in opposite ends of the second lever for manipulating and disabling the closing means for releasing the latch post for movement from the reentrant slot; and means on the first and second levers for selectively preventing the first and second levers from moving independently of each other including aligned first apertures in the first and second levers on a first side of the bracket for receiving the hasp of a padlock and a third lever pivoted to the bracket and providing an aperture aligned with the first apertures.

2. The latch of claim 1 wherein the second lever is pivotally mounted on the first lever.

3. The latch of claim 1 further comprising means biasing the first and second levers toward the latched position.

4. The latch of claim 3 wherein the biasing means comprises a first spring connected between the first lever and the bracket for biasing the first lever toward the latched position and a second spring connected between the second lever and the bracket for biasing the second lever toward the latched position.

5. The latch of claim 1 wherein the bracket comprises a first generally planar section generally parallel to the plane of pivotal movement of the lever and a second section transverse to the first section providing a slot for receiving the lever, the lever and the second section providing the closing means in the latched position of the latch.

6. The latch of claim 1 wherein the lever is pivotally mounted on the bracket for movement in a generally vertical plane perpendicular to the gate.

7. The latch of claim 1 wherein the first and second levers comprise aligned second apertures on the second side of the bracket.

8. A latch for a fence gate of the type pivoted between a pair of spaced posts for movement about a vertical axis and having a latch post carried thereon, comprising a bracket for attachment to one of the fence posts;

a first lever pivoted to the bracket and having a reentrant slot for receiving the latch post in a latched position of the latch;

means carried by the bracket for closing the reentrant slot of the lever in the latched position of the latch for locking the latch post in the reentrant slot; a second lever pivoted for movement relative to the first lever and including means for closing the reentrant slot of the first lever in the latched position of the latch for locking the latch post in the reentrant slot;

means for manipulating and disabling the closing means for releasing the latch post for movement from the entrant slot; and means on the first and second levers for selectively preventing the first and second levers from moving independently of each other including aligned apertures in the first and second levers on a first side of the bracket for receiving the hasp of a padlock.

9. A latch for a fence gate of the type pivoted between a pair of spaced posts for movement about a vertical axis and having a latch post carried thereon, comprising a bracket for attachment to one of the fence posts;

a first lever pivoted to the bracket and having a reentrant slot for receiving the latch post in a latched position of the latch;

means carried by the bracket for closing the reentrant slot of the first lever in the latched position of the latch for locking the latch post in the reentrant slot;

means on opposite ends of the first lever releasing the latch post for movement out of the reentrant slot; and means carried by the bracket for selectively preventing movement of the lever and thereby preventing release of the latch post from the reentrant slot; the preventing means including a second lever pivoted relative to the bracket and aligned apertures in the first and second levers on a first side of the bracket for receiving the hasp of a padlock.

* * * * *